US006286710B1

(12) United States Patent
Paek

(10) Patent No.: US 6,286,710 B1
(45) Date of Patent: Sep. 11, 2001

(54) VENDING MACHINE AND CONCURRENTLY ICE-BOX

(76) Inventor: Myeong Gi Paek, 333-3, Yaksuri, Bukhamyun, Jangsungkun, Jeonlanamdo, 515-850 (KR)

( * ) Notice: Subject to any disclaimer, the term of this patent is extended or adjusted under 35 U.S.C. 154(b) by 0 days.

(21) Appl. No.: 09/360,696

(22) Filed: Jul. 26, 1999

(51) Int. Cl.[7] ..... G07F 11/00; G07F 11/72; A24F 27/14; B65D 83/00

(52) U.S. Cl. ..... 221/8; 221/124; 221/127; 221/150 HC

(58) Field of Search ..... 221/123, 124, 221/127, 133, 7, 8, 150 R, 150 HC, 153, 219, 241

(56) References Cited

U.S. PATENT DOCUMENTS

| | | | | |
|---|---|---|---|---|
| 2,661,992 | * | 12/1953 | Harris | 221/129 |
| 2,874,873 | * | 2/1959 | Newell | 221/123 X |
| 4,278,182 | * | 7/1981 | Ahlstrom | 221/123 X |
| 4,298,138 | * | 11/1981 | Oden | 221/115 X |
| 4,834,231 | * | 5/1989 | Awane et al. | 221/7 X |
| 4,852,767 | * | 8/1989 | Humprhey | 221/241 X |
| 4,991,740 | * | 2/1991 | Levasseur | 221/129 |
| 5,240,139 | | 8/1993 | Chirnomas . | |
| 5,259,530 | * | 11/1993 | Ishine et al. | 221/124 X |
| 5,404,797 | | 4/1995 | Millar . | |
| 5,613,620 | * | 3/1997 | Center et al. | 221/133 X |
| 5,799,822 | | 9/1998 | Rudewicz et al. . | |
| 6,068,156 | * | 5/2000 | Liff et al. | 221/7 X |
| 6,078,896 | * | 6/2000 | Kaehler et al. | 221/8 X |
| 6,109,059 | * | 8/2000 | Lebrun | 221/150 R X |

* cited by examiner

*Primary Examiner*—Christopher P. Ellis
*Assistant Examiner*—Gene O. Crawford
(74) *Attorney, Agent, or Firm*—McDermott, Will & Emery

(57) ABSTRACT

There is provided a vending machine and concurrently ice-box furnished in a hotel room, etc. that serves the paying guest of the room with cold water and personal articles as a room service and enables them to conveniently purchase various kinds of beverages and drinks such as beer and side dishes for wine as they likes, wherein the vending machine and concurrently ice-box is provided with a counting function in itself. In a vending machine and concurrently ice-box with a cabinet-type main body having a relatively cold region formed therein, the vending machine and concurrently ice-box includes: an ice-box compartment for keeping food in the defined cold region of the main body; and a vending machine reservation compartment located at a position adjacent to the ice-box compartment in the main body, wherein the vending machine reservation compartment is sequentially provided with at least one kind of commercial beverage and drink cans and releases any one of the beverage and drink cans selected according to a specified order condition.

2 Claims, 4 Drawing Sheets

VENDING MACHINE AND CONCURRENTLY ICE-BOX

BACKGROUND OF THE INVENTION

1. Field of the Invention

The present invention relates to a vending machine and concurrently ice-box and, more particularly, to a vending machine and concurrently ice-box that has an integral form of a vending machine from which cold beverage and drink cans are obtained by putting a coin into it, and an ice-box where food is kept cool for a long time.

2. Discussion of Related Art

An ice-box is a box used to keep food cool for a long time and usually kept in a public place such as a fashionable hotel, etc. so as to provide paying guests with beverages and drinks.

When furnished in a hotel room, the ice-box is provided with a variety of beverage and drink cans for various tastes of the guests so that any paying guest can take beverages and drinks from it as he likes.

However, most of the related art ice-boxes are a closed box with no display function so that the guest has to open the door of the ice-box and see what kind of drinks are available.

For that reason, the related art ice-boxes are not so attractive to the paying guest visually, as a result of which the effect of sales promotion is deteriorated. Furthermore, an ordinary ice-box is designed to have multiple purposes and functions for a domestic use and therefore inadequate for sales of beverage and drink cans in a hotel room.

In addition, a service worker who takes care of the ice-box in the hotel must take the trouble to enter the room in person to check on what kind of drinks and how many drinks are taken by the guest and to charge the guest for the drinks right before the guest checks out. In a case where the ice-box is filled with beverage and drink cans of different kinds which determine the price of the individual beverage and drink cans, the service work has difficulty in billing the guest for the beverage or drink cans. There are some cases where the service worker charges the guest incorrectly so that he suffers from a large pecuniary loss. Therefore, most of ice-boxes have been managed in many hotels unavoidably under actual circumstances that a part of the sales amount for the beverage and drink cans in the ice-box is taken as a deficit. In some hotels, the guests are urged to deposit a certain amount of money in cash as prepayment for the use of the ice-box content during the check-in and repaid with a change before they check out.

Furthermore, there are some cases where the guest cannot remember accurately what beverages and drinks he had from the ice-box and takes much time in waiting for the confirmation of the service worker. In some cases, the guest is brought in a shameful situation when he remembers inaccurately. Those who use a hotel room equipped with no mini-bar has to take the trouble to call the service worker in order to order beverages or drinks. Since most of paying guests in a hotel room are reluctant to expose themselves to others, they usually give up ordering beverages or drinks and the ice-box in the room becomes useless.

In some rare cases, the hotel employs a terminal management system that automatically checks the beverages and drinks taken by the guest. However, such an automatic system is very expensive and ready to cause conflicts between the guest and the service worker frequently because the terminal management system may charge the guest even for an article moved slightly by mistake of the guest who is inexperienced in dealing with the system. The system is also disadvantageous in that it cannot receive articles out of a standard size.

SUMMARY OF THE INVENTION

It is therefore an object of the present invention to provide a vending machine and concurrently ice-box furnished in a hotel room, etc. that serves the paying guest of the room with cold water and personal articles as a room service and enables them to conveniently purchase various kinds of beverages and drinks such as beer and side dishes for wine as they likes, wherein the vending machine and concurrently ice-box is provided with a counting function in itself.

To achieve the first object of the present invention, in a vending machine and concurrently ice-box with a cabinet-type main body having a relatively cold region formed therein, the vending machine and concurrently ice-box includes: an ice-box compartment for keeping food in the defined cold region of the main body; and a vending machine reservation compartment located at a position adjacent to the ice-box compartment in the main body, wherein the vending machine reservation compartment is sequentially provided with at least one kind of commercial beverage and drink cans and releases any one of the beverage and drink cans selected according to a specified order condition.

It is preferable that the ice-box compartment used herein includes: a controller for generating a order signal according to the specified order condition; and a rack unit for sequentially receiving at least one kind of the beverage and drink cans in the up-to-down direction and releasing any one of the beverage and drink cans based on the order signal.

It is preferable that the rack unit used herein includes: at least one rack for receiving at least one kind of the beverage and drink cans in the up-to-down direction; at least one driver motor turning at predetermined revolutions per minute according to the order signal received from the controller; and a rotatory cam for releasing one of the beverage and drink cans contained in the rack by a turning operation of the driver motor.

It is preferable that an exchange condition provider is further provided on the front surface of the vending machine reservation compartment, for providing the controller with a specified exchange condition for at least one of the beverage and drink cans to be released in accordance with the order condition.

It is preferable that the exchange condition provider used herein includes: a coin and note reader for sensing inserted coins and notes corresponding to the amount of the at least one of the beverage and drink cans as the exchange condition, and providing the order condition to the controller; and a card reader for sensing a predetermined amount of money stored in a magnetic card inserted as the exchange condition, and providing the order condition to the controller.

It is preferable that the magnetic card used herein is provided with a predetermined amount of money in prepayment, and if necessary, an amount of money remaining in the magnetic card is repaid to a user of the magnetic card, wherein the remaining money in the magnetic card is calculated by subtracting an amount of money corresponding to the price of the released at least one beverage and drink can from the amount of money prepaid.

It is preferable that a count display is further provided in a portion adjacent to the exchange condition provider, for displaying the type of the exchange condition and acceptable status, counting the number of the released beverage and drink cans and displaying the counted number.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Hereinafter, the present invention will be described in detail with reference to the accompanying drawings.

Figure 1:
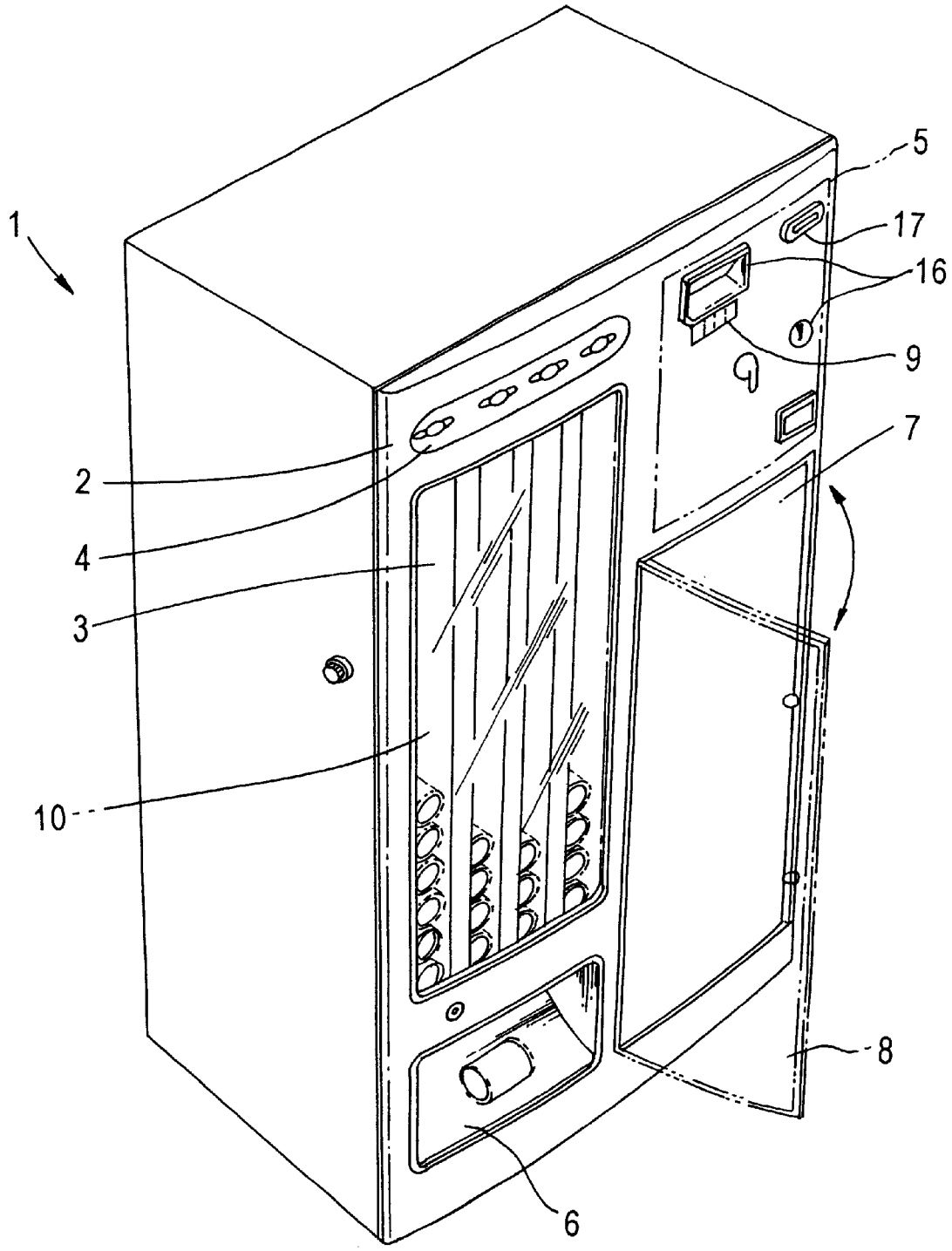
FIG. 1 is a perspective view of a vending machine and concurrently ice-box according to the present invention.
Figure 2:
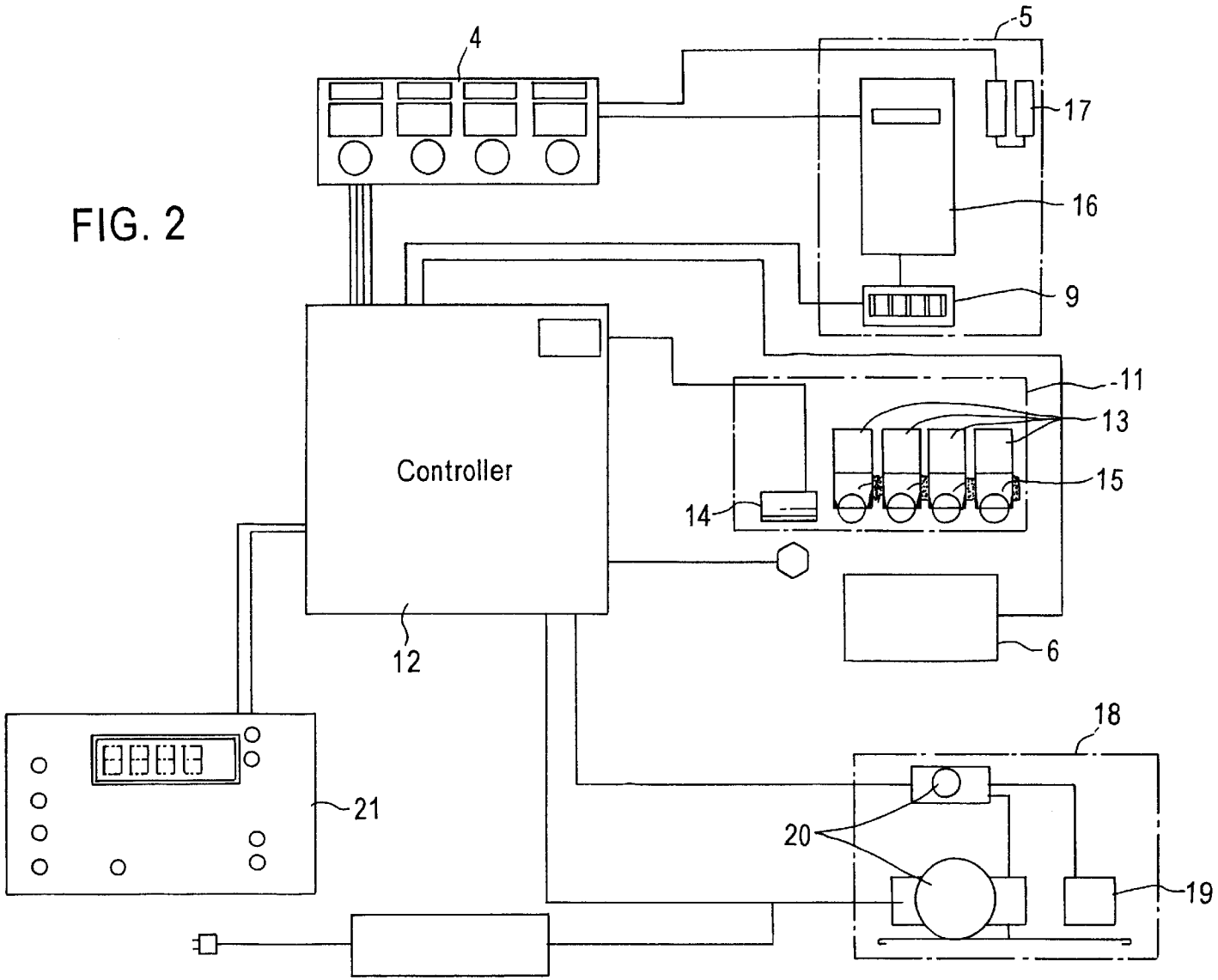
FIG. 2 is an illustrative diagram of the control state of the vending machine and concurrently ice-box according to the present invention.
Figure 3:
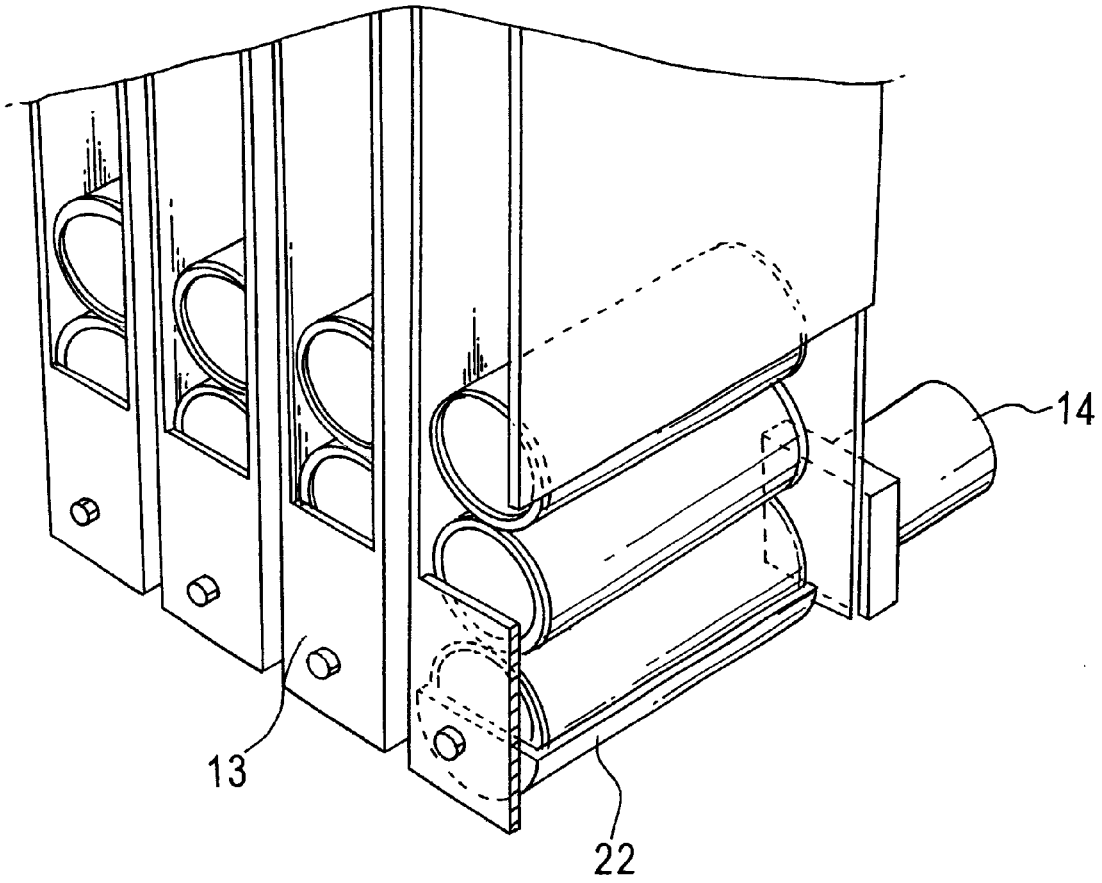
FIG. 3 is a perspective view of a rack unit shown in FIG. 2.
Figure 4:
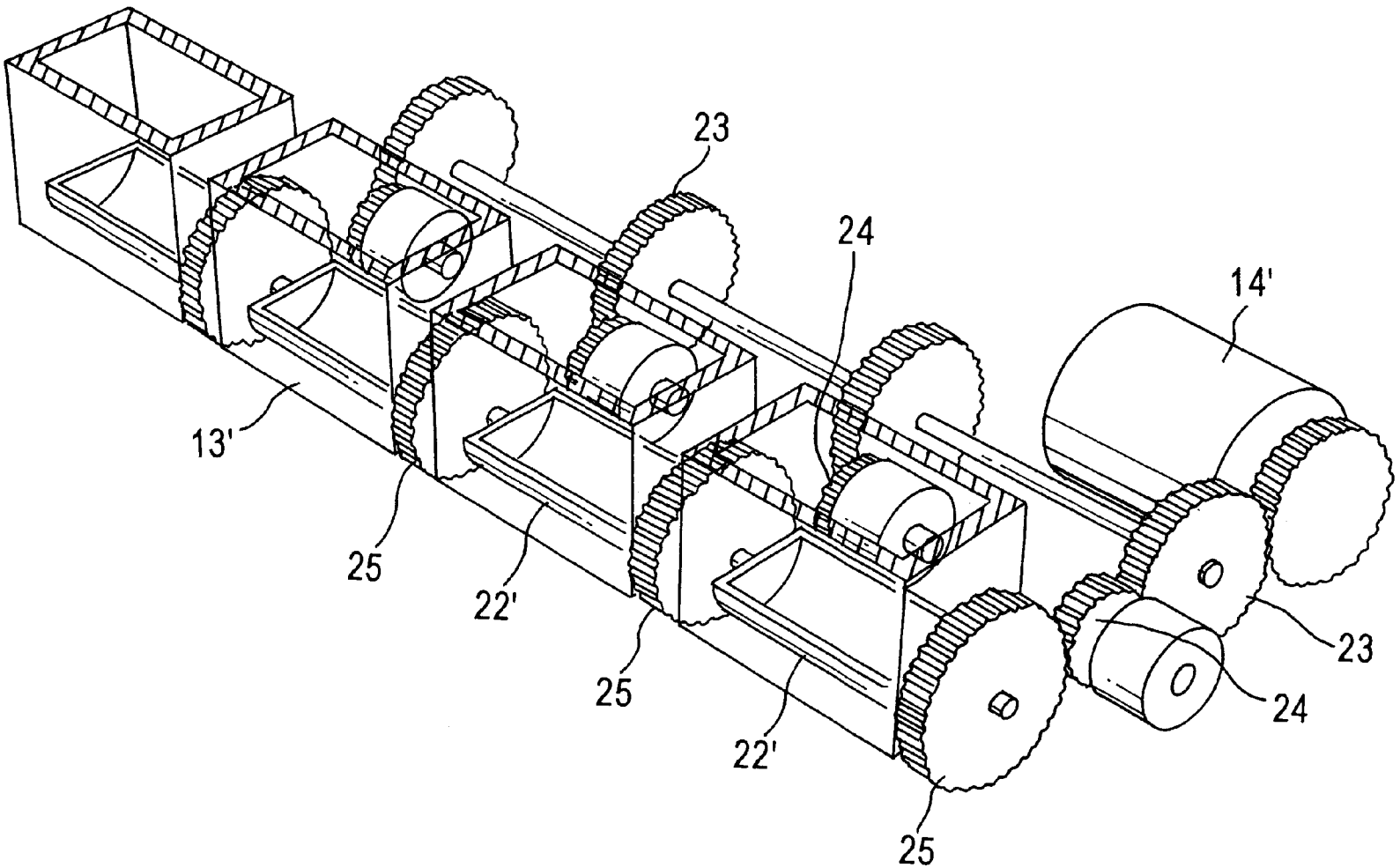
FIG. 4 is an illustrative diagram of a rack unit shown in FIG. 3 according to another embodiment of the present invention.

FIG. 1 is a perspective view of a vending machine and concurrently ice-box according to the present invention. FIG. 2 is an illustrative diagram of the control of the vending machine and concurrently ice-box according to the present invention and FIG. 3 is a perspective view of a rack unit shown in FIG. 2. FIG. 4 is an illustrative diagram of a rack unit shown in FIG. 3 according to another embodiment of the present invention.

As shown in FIG. 1, the present invention vending machine and concurrently ice-box includes a main body 1 that looks like a cabinet having a relatively cold region formed therein and an opening provided in the cold space, and a door 2 hinged with the opening of the main body 1 by means of a hinge pin (not shown).

The door 2 has a transparent window 3 that faces towards the outside so that a predefined part of the cold region is exposed to the outside. Above the transparent window 3 are provided select buttons 4 that are pushed by a user to choose a desired beverage or drink. An exchange condition provider 5 for supplying exchange conditions to take out the beverage or drink is provided on the right hand of the select buttons 4, and an outlet 6 for the selected beverage or drink is formed below the transparent window 3. And, in the rest part of the door 2 is provided a receipt door 8 for an opening of an ice-box compartment 7 with a space large enough to receive food to be kept cool. A door sensor (not shown) for sensing the open/closed status of the door 2 is located in the contact region of the door 2. The door sensor generates an abnormality signal.

A count display 9 is provided in a region adjacent to the exchange condition provider 5. The count display 9 displays the number of exchange condition and the status of available articles, counts the number of articles taken out by the user and displays the count value visually. Here, the count display 9 the count value, the type of the exchange condition and the status of available articles under the control of a controller provided in the main body 1.

The ice-box compartment 7 formed inside the main body 1 provides a receipt space that maintains a required low temperature and receives food to be reserved. Inside the main body 1 seen from the transparent window 3, a vending machine reservation compartment 10 is formed adjacent to the ice-box compartment 7. At least one kind of beverage and drink cans are sequentially received in the vending machine reservation compartment 10 and one of the beverage and drink cans is released from it according to a specified order condition. In the ice-box compartment 7 are arranged racks (not shown) that are divided into upper and lower parts in order to easily receive articles to be reserved. Further, an airtight band (not shown) not allowing air to pass in or out is provided on the margin of the ice-box compartment 7 and get in airtight contact with the receipt door 8.

The vending machine reservation compartment 10 includes, as shown in FIG. 2, the controller 12 for generating a order signal to a rack unit 11 according to a specified order condition. The rack unit 11 receives at least one kind of the beverage and drink cans in the up-to-down direction. The user can take at least one beverage and drink can out of the rack unit 11 according to the order signal. Here, the controller 12 controls the entire system. A sellout sensor 15 for sensing the number of available cans is provided in a rack 13.

The exchange condition provider 5 includes a coin reader 16 and a card reader 17. The coin reader 16 senses inserted coins or notes corresponding to the price of the selected beverage and drink cans and provides the order condition to the controller 12. The card reader 17 senses a magnetic card which stores a predetermined amount of money, and provides the order condition to the controller 12 only when the stored money exceeds the price of the selected beverage and drink can. The magnetic card can be provided with a predetermined amount of money in prepayment as much as the user wants and the money remaining in the card is calculated by subtracting the total price of the selected beverage and drink cans from the predetermined amount of money. If necessary, the service worker repays the remaining money to the user.

The ice-box further includes a cooling system 18 for supplying a cooling air to the ice-box compartment 7. The cooling system 1.8 includes an inner heat exchanger (not shown) for heat-exchanging from a warm air to a cold air, a compressor 19 for compressing and transferring a gaseous coolant to be heat-exchanged into the warm air in the heat exchanger, and an outer heat exchanger (not shown) for changing the warm air heat-exchanged at the inner heat to a cold liquid. Each of the inner and outer heat exchanger is provided with an air-blowing fan 20. There is formed a coolant pipe (not shown) between the above units to guide the flow of the coolant. A temperature-regulator 21 is internally provided in either one of the ice-box compartment 7 or the vending machine reservation compartment 10 in order to control the temperature of them.

As illustrated in FIG. 3, the rack unit 11 includes a plurality of racks 13 that has at least one space for receiving the beverage and drink cans separately in the up-to-down direction, a rotatory cam 22 for releasing the cans charged in the rack 13 and allowing them to be dropped, and a driver motor 14 for turning the rotatory cam 22 by a predetermined angle as the select buttons 4 are pushed under the order condition. In an ordinary state, the rotatory cam 22 restricts the can positioned at the bottom of the rack 13. As the user provides the order condition, the rotatory cam 22 is driven by the driver motor 14 to turn by the predetermined angle so that the can at the bottom of the rack 13 is allowed to be dropped, and immediately after this, restricts the next can right on the dropped can. Here, the rotatory cam 22 and the driver motor 14 are provided as many as the rack 13.

In accordance with another embodiment of the present invention, as illustrated in FIG. 4, a rotatory cam 22' is selectively driven by the rotation of one driver motor 14'. For this, a rack unit 11 includes a transfer gear 24 for separately transferring the torque received from a driver motor 14' to four racks 13', a driving gear 25 for directly driving the rotatory cam 22', and a select gear 24 for selectively transferring a driving power between the driving gear 25 and the transfer gear 24 under the control of a order signal of the controller 12 in order to select any one of racks 13'. Here, the select gear 24 is provided with a solenoid (not shown) that reciprocates the select gear 24 under the control of the order signal received from the controller 12.

The present invention vending machine and concurrently ice-box is furnished in the rooms of a hotel and the like and enables the paying guest to take beverage and drink cans out of the rack unit 11 of the vending machine reservation compartment 10 without calling a service worker in the front desk. That is, the guest has only to insert coins or notes as much as a required amount of money, or a magnetic card into the vending machine reservation compartment 10 in the room. The magnetic card is available from the front desk in advance.

For instance, as the paying guest inserts coins and notes into the exchange condition provider 5 of the vending machine reservation compartment 10, the controller 12 calculates the amount of input money, determines whether the order for the beverage and drink cans is acceptable within a specified order condition, and displays on the select buttons 4 which beverage and drink cans are available with the amount of money. The guest then gives an order for the beverage and drink cans available as displayed with the select buttons 4 in consideration of his taste. Thereafter, the controller 12 senses the order and controls the rack unit 11 that stores the beverage and drink cans.

If the guest inserts a magnetic card corresponding to a predetermined amount of money into the card reader 17, the card reader 17 reads the amount of money from the magnetic card and transmit the value to the controller 12. The controller 12 calculates the a amount of money remaining in the magnetic card to determine whether the order for the beverage and drink cans is acceptable within the order condition. Then, the controller 12 displays on the select buttons 4 what kinds of cans are available within the amount of money, and controls the rack unit 11 to take out the beverage and drink cans according to the select buttons 4 selectively pushed by the guest.

In a case where the magnetic card still has a money, the guest can be repaid with the change at the front desk.

Of course, the guest may be served with free drinks and water kept in the ice-box compartment 7 as a room service. The guest also can keep externally supplied food cool in the ice-box compartment 7 for a long time.

On the other hand, in a case where there is no beverage and drink can in the racks 13 of the rack unit 11, the controller 12 checks on the presence of the beverage and drink cans with the sellout sensor 15, displays sellout signals on the select buttons 4 and restricts the selection of the select buttons 4. Also, the controller 12 checks on whether the door 2 is open or closed, and prevents sealing with alarm or siren wailing when the door 2 is unacceptably opened.

As described above, the present invention provides the paying guest of a hotel room with free food, water, etc. in the ice-box compartment as a room service and, at the same time, conveniently supplies the guest with a desired beverage and drink can in the vending machine reservation compartment according to a specified exchange condition. Since the guest can choose the beverage and drink cans displayed in the vending machine reservation compartment through the transparent window, the present invention has an effect of sales promotion and does not require the service worker to check on the articles taken by the guest. This makes it possible to reduce unnecessary manpower and decreases an economical load in the aspect of the hotel management as well as sales profits enhanced.

Furthermore, the present invention has a calculating function in itself so as to facilitate management and account.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A vending machine and concurrently ice-box; configured to be furnished in the rooms of a hotel and the like, with a cabinet-type main body having a cold region formed therein, the vending machine comprising:

a partition for dividing the cold region inside the main body into upper and lower parts or right and left parts, respectively;

a receipt reservation compartment provided on one side of the partition, the receipt reservation compartment having a predefined low temperature maintaining space configured to receive food and having an opening therein;

a receipt reservation compartment door movably provided to cover the opening and provide access to an interior of the receipt reservation compartment;

a vending machine reservation compartment, disposed on another side of the partition, configured to receive more than one kind of can among commercial beverage and drink cans; and a cooling system for cooling at least one of the vending machine reservation compartment and the receipt reservation compartment.

2. A vending machine and concurrently ice-box according to claim 1, wherein the receipt reservation compartment door is configured to pivot about one side of the door, a substantially airtight band is provided about a circumference of the opening, and the door is configured to pivot into and out of contact with the band to provide access to an interior of the receipt reservation compartment.

* * * * *